US007207455B2

(12) United States Patent
Sheng

(10) Patent No.: US 7,207,455 B2
(45) Date of Patent: Apr. 24, 2007

(54) TEMPLATE FOR CARRYING BULK CARGO IN AN ACTIVE CONTAINER

(76) Inventor: Jun Sheng, Room 1002, No. 12, Lane 169, Bailan Road, Shanghai (CN)

( * ) Notice: Subject to any disclaimer, the term of this patent is extended or adjusted under 35 U.S.C. 154(b) by 0 days.

(21) Appl. No.: 10/891,081

(22) Filed: Jul. 15, 2004

(65) Prior Publication Data

US 2005/0118005 A1 Jun. 2, 2005

Related U.S. Application Data

(63) Continuation of application No. PCT/CN03/01031, filed on Dec. 1, 2003.

(51) Int. Cl.
*B65D 88/00* (2006.01)

(52) U.S. Cl. ..... 220/1.6; 410/140

(58) Field of Classification Search ..... 220/1.5, 220/1.6, 323, 495.06, 495.1, 601, 694, 729; 410/129, 142, 144, 140; 160/135
See application file for complete search history.

(56) References Cited

U.S. PATENT DOCUMENTS 3,017,842 A * 1/1962 Nampa ..... 410/133
3,386,605 A * 6/1968 Lafont ..... 220/1.5
3,951,284 A * 4/1976 Fell et al. ..... 414/812
5,080,950 A * 1/1992 Burke ..... 428/81
6,206,623 B1 * 3/2001 Podd ..... 410/130
2003/0230573 A1 * 12/2003 Enge et al. ..... 220/1.5

FOREIGN PATENT DOCUMENTS

GB 2193949 A * 2/1988

* cited by examiner

*Primary Examiner*—Anthony D. Stashick
*Assistant Examiner*—Harry Grosso
(74) *Attorney, Agent, or Firm*—Birch, Stewart, Kolasch & Birch, LLP

(57) ABSTRACT

A template for carrying bulk cargo in an active container. The template includes a folding template body; a template connecting piece and a discharge door, the template body having at least a portion thereof which connects by the connecting piece to form the folding template body; and multiple template locks on the template body, each template lock having a locking bar and a lock head. The template body is fixed to upright post of a doorframe of the container by inserting the locking bars of the template locks into the doorframes. Sealing members are provided on two sides of the template body. The discharge door is located at a lower end of the template body. The template makes it possible to load bulk granule and powdered form goods directly into an existing container, without altering the container, thus reducing manpower and damage to the goods during loading, unloading, and transporting.

15 Claims, 5 Drawing Sheets

TEMPLATE FOR CARRYING BULK CARGO IN AN ACTIVE CONTAINER

CROSS-REFERENCE TO RELATED APPLICATION

This application is a Continuation of co-pending PCT International Application No. PCT/CN03/01031, filed Dec. 1, 2003, which designated the United States, and on which priority is claimed under 35 U.S.C. § 120, the entire contents of which are hereby incorporated by reference.

FIELD OF THE INVENTION

This utility model relates to a device for a container for loading and unloading goods, and more particularly to a structure of special template for a cargo container used for shipping bulk granule and powdered form goods.

DESCRIPTION OF THE PRIOR ART

Containers are commonly used for shipping goods at home and abroad. However, when bulk granule materials and powdered form goods, such as grain, chemicals, industrial raw materials, or similar goods are to be transferred in containers, problems may result. Owing to the structural restrictions of the container itself, bulk granule materials and powdered form goods have to be bagged before they can be loaded into the container for transportation. As a result, a great deal of packaging material, manpower, and time are wasted.

In addition, during the process of filling and packaging the bags, cargo may be damaged and pollution of the goods and the environment may take place. Therefore, at present, the transfer of bulk granule materials and powdered form goods in containers is restricted, especially when bulk granule materials and powdered form goods need to be transferred in combined transport. Combined transport is strictly supervised, controlled and restricted by customs regulations; thereby the trade of import and export of bulk granule and powdered form goods among nations of the world is greatly limited.

SUMMARY AND OBJECTS OF THE INVENTION

The purpose of this utility model is to solve above problem, and to create a frame or special template for containers which eliminates the need for bagging of bulk granule materials and powdered form goods for containerized shipment.

The present utility model mainly has the following constructions:

Included are a template body, a template connecting piece, and a discharge door, the template body having at least a portion thereof connected together by the connecting piece to form a folding template body. Multiple template locks are provided on the template body. Each of the template locks includes a locking bar and a lock head. The template body is fixed to upright posts of the doorframe of the container by inserting the locking bar of the template lock into the upright posts of the doorframe. There are sealed strips at the both sides of the template body, and a discharge door is located at the lower end of the template body. The advantages of this utility model include a simple and reasonable structure that can be used directly in an existing container to load bulk granule and powdered form goods, without the need to alter the container itself. As a result, a great deal of packaging material, manpower, and time are saved. In addition, during the process of loading, transporting, and unloading, damage to the cargo and pollution of the cargo and the environment can be greatly reduced. Further, the storage of goods can be facilitated, and combined shipments can be controlled and transported together.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Next, embodiments of the utility model will be described with reference to the figures:

EXAMPLE 1

Figure 1:
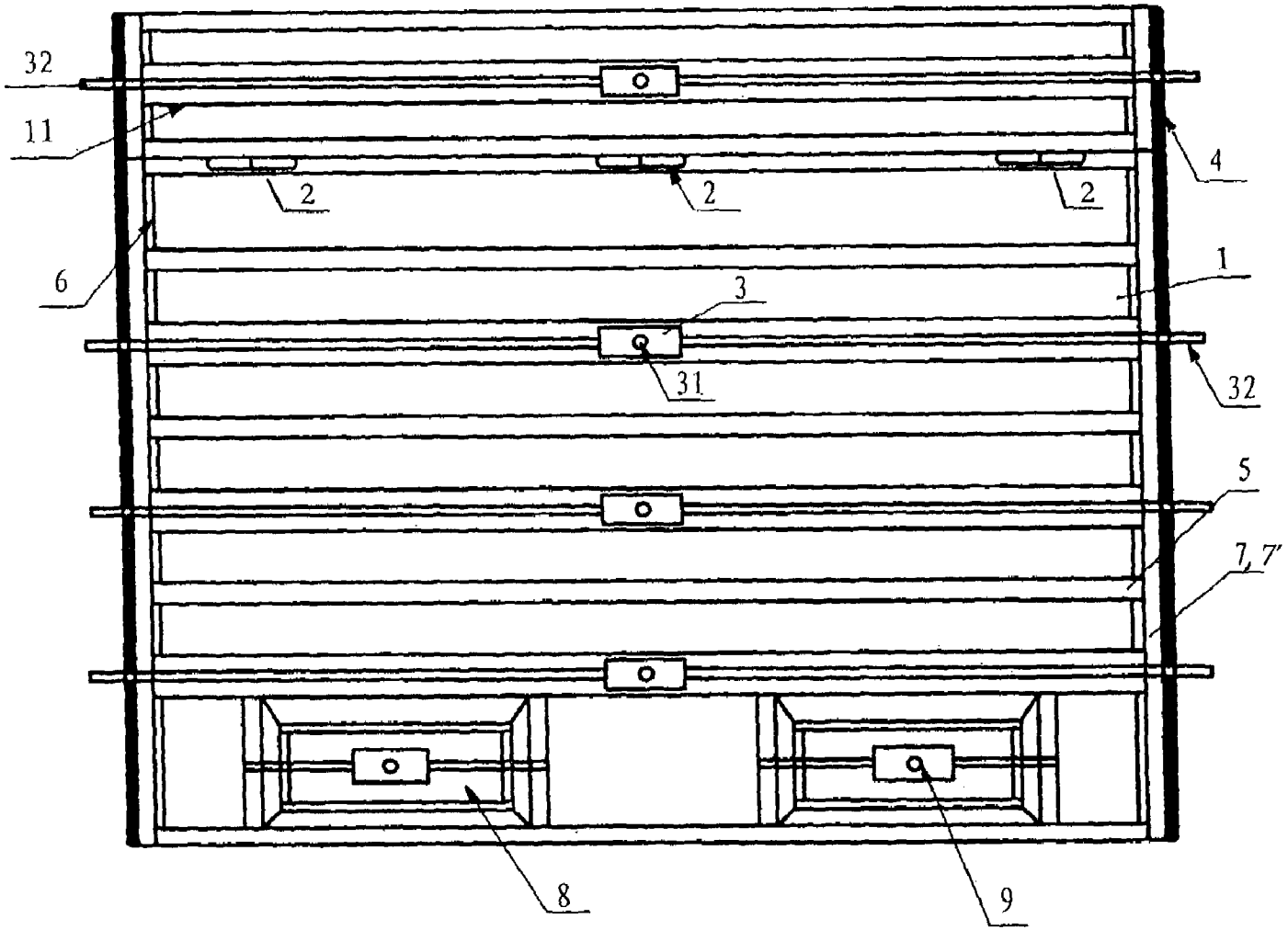
FIG. 1 is a schematic view of the structure of this utility model.
Figure 2:
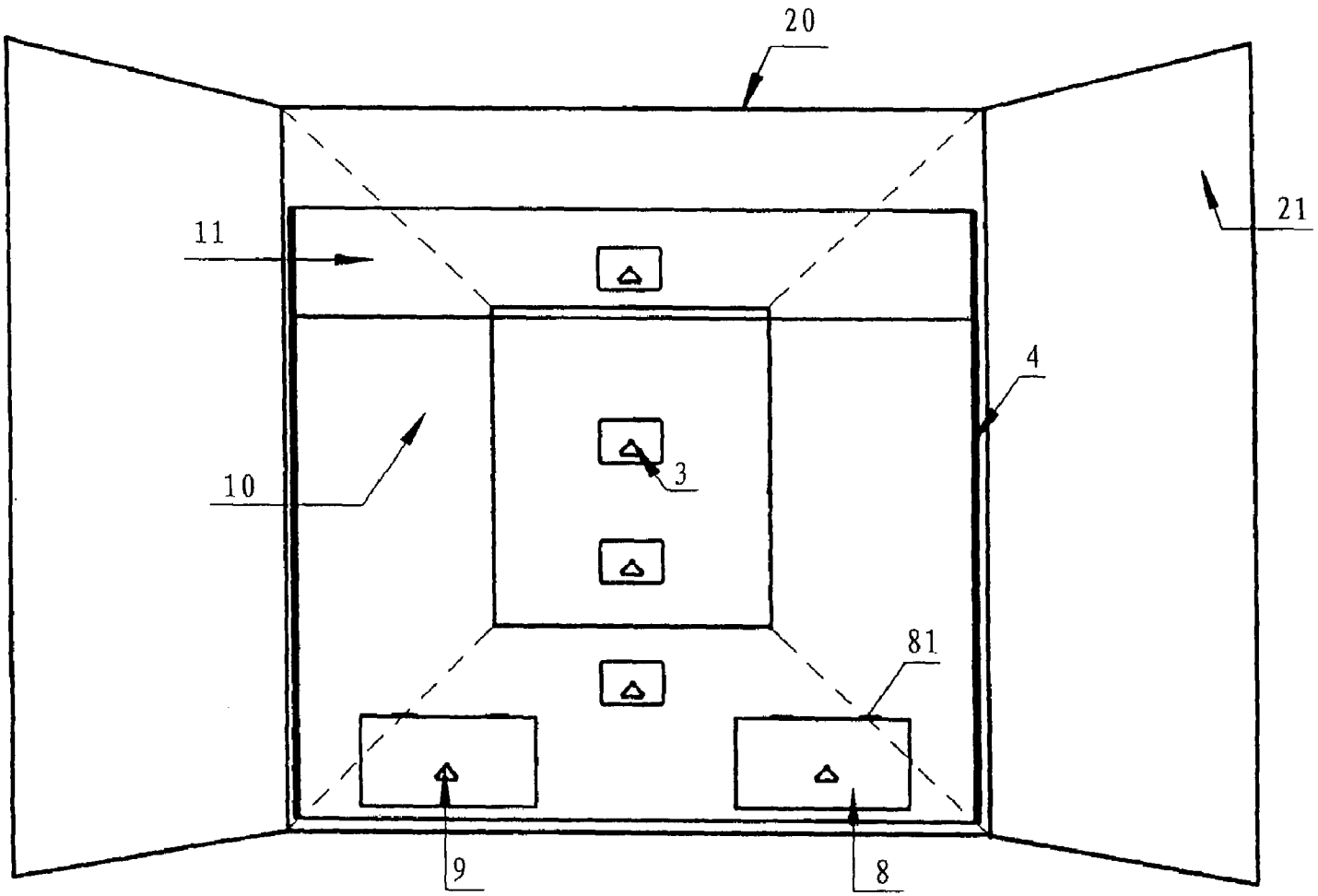
FIG. 2 is a schematic view of the structure of this utility model assembled in a container.
Figure 3:
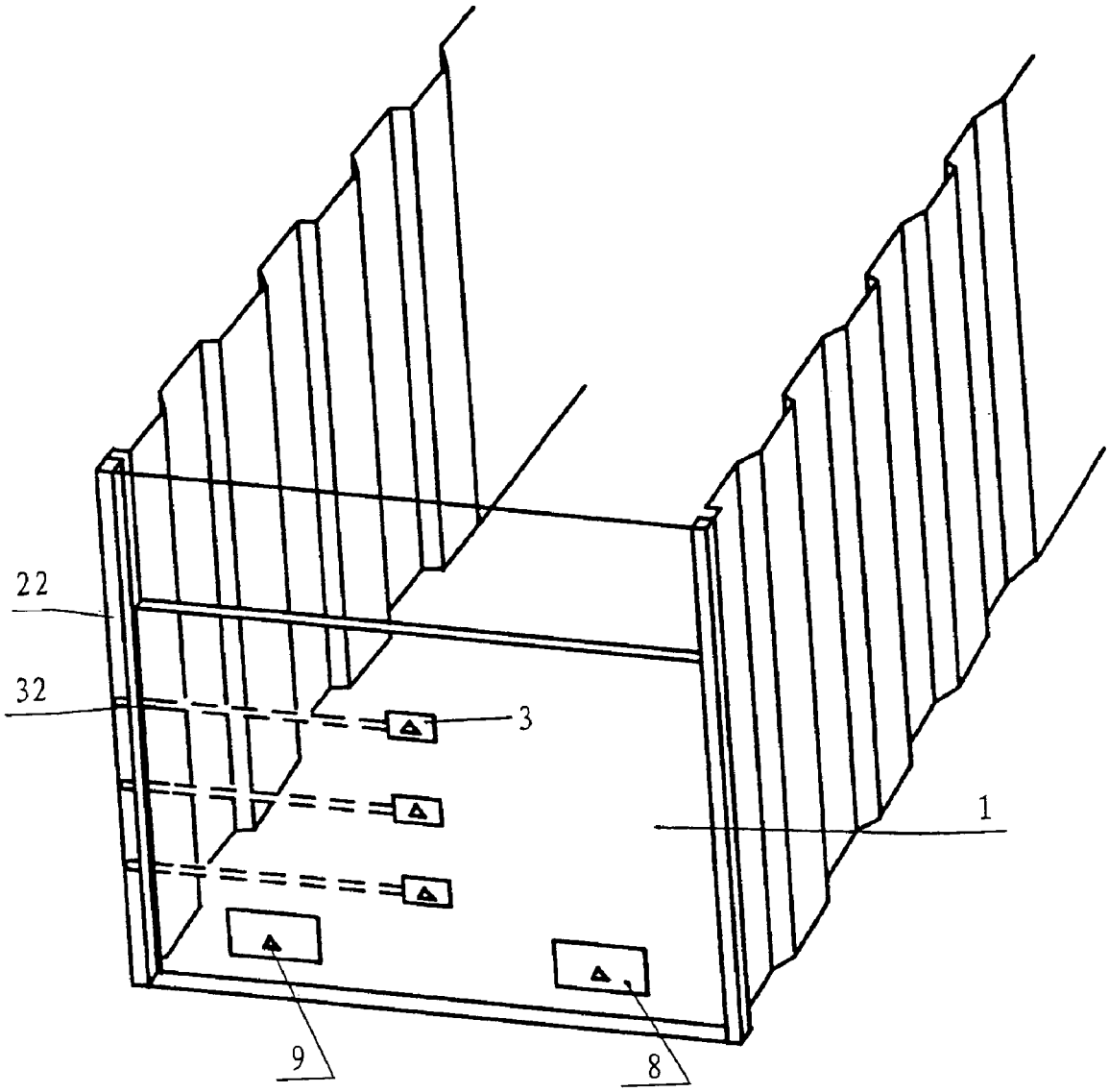
FIG. 3 is a schematic view of the fixed structure of this utility model assembled in a container.

As shown in FIG. 1, the main template 10 and one auxiliary template 11 are connected to each other to form template body 1 by connecting pieces 2. FIG. 1 shows the main template 10 and auxiliary template 11 being an upper template and a lower template, and the connecting pieces 2 being by multiple latch hinges. The main template 10 is equipped with three template locks 3, and the auxiliary template 11 being equipped with one template lock 3. Template locks 3 each include a lock bar 32 and a lock head 31. Lock head 31 is a gear rotating machinery lock (not shown in the drawing), and locking bar 32 is connected with the lock head 31 through the gear. The rotating gear drives the lock bar 32 to protrude, which causes the template body 1 to connect to upright posts 22 of the doorframe of the container door 21 for fixation (See FIGS. 2 and 3). When the cargo to be carried in the container is such that use the special template is not needed, the template body 1 can be easily removed by simply rotating template lock 3 in reverse to cause the lock bar 32 to retract.

Multiple strengthening ribs 5 are provided in a transverse direction on the template body 1, and strengthening ribs 6 are set up in a longitudinal direction on both sides of the template body 1. A hollow steel tube 7 is established around the periphery of template body 1. Alternatively, peripheral edges 7' of template body 1 may be pressed molded into flanged edges in order to increase the overall strength of the template body 1.

Rubber seal strips 4 are provided at the edges of both sides of template body 1. The lower end of main template 10 of template body 1 is equipped with two discharge doors 8 which are pendent doors connected with main template 10 of template body through hinges 81. There are door locks 9 on the discharge doors 8.

Figure 6:
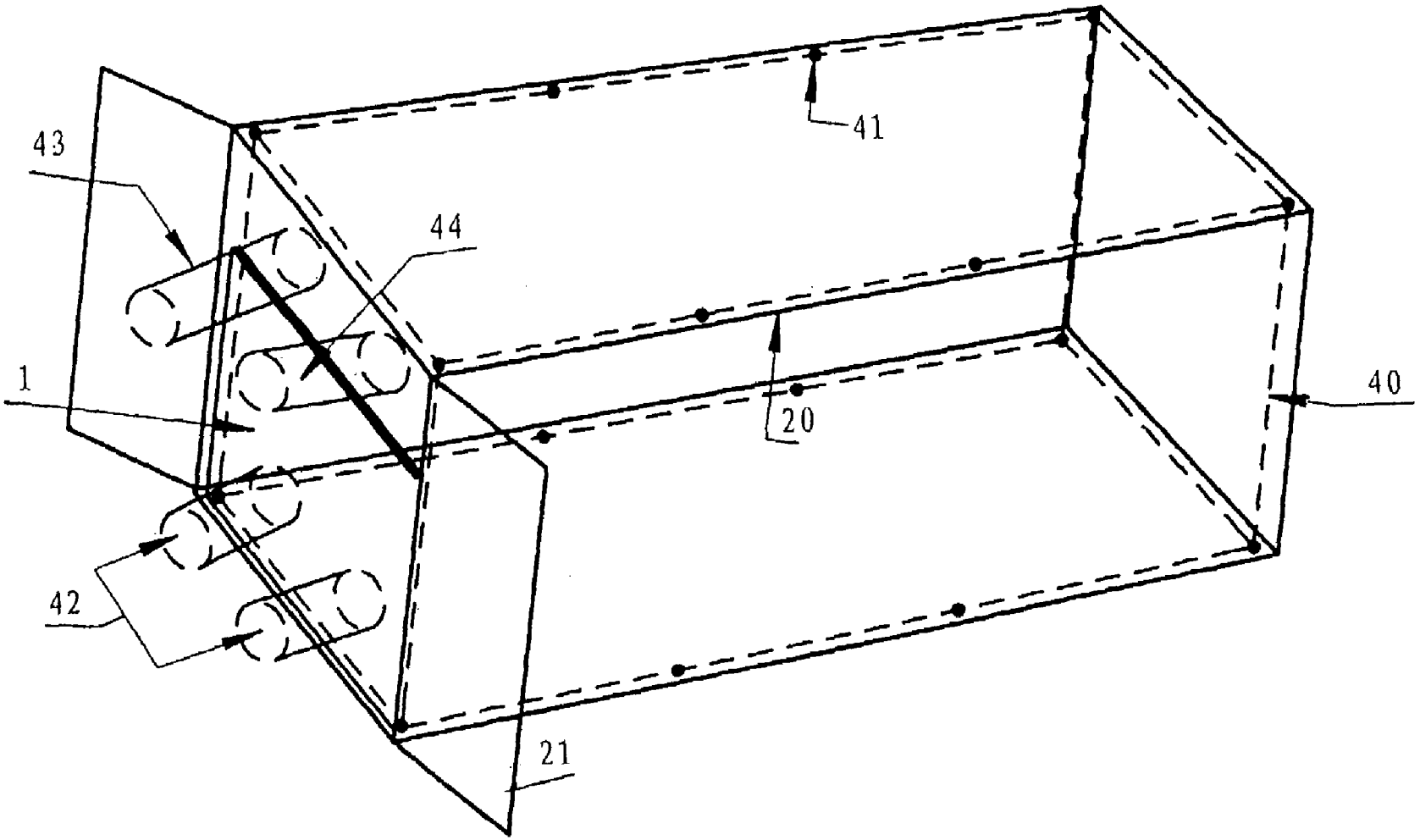
FIG. 6 is a schematic view of the structure of a bulk cargo underlay bag in this utility model.

In order to empty the container, and at the same time ensure that the goods will be free from pollution, a bulk cargo underlay bag 40 may be added used into template body 1 when it is fixed in the container. (See FIG. 6)

The underlay bag 40 is made of polyethylene film. Many connector links 41 are provided in the outer periphery of the bag 40 which are used to connect with inside edge connector links of container 20, thus positioning the bag 40. Two discharge ports 42 are provided at an end of underlay bag 40 that is adjacent to the under part of container door 21, and a loading port 43 and a return air port 44 are established in an upper part of the end of the bag. The discharge ports 42, the loading port 43, and the return air port 44 are outward expanding, soft bucket-shaped objects. These bucket-shaped objects may be made of the same material as that of underlay bag 40.

EXAMPLE 2

Figure 4:
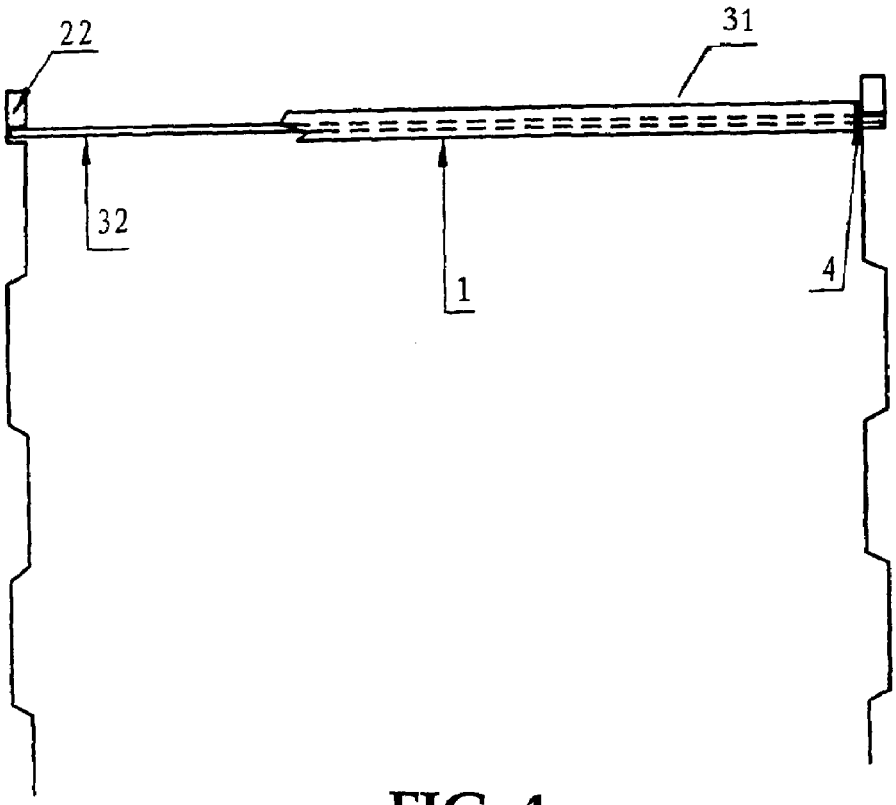
FIG. 4 is an overhead view of the connecting fixed structural between this utility model and a container doorframe upright post.
Figure 5:
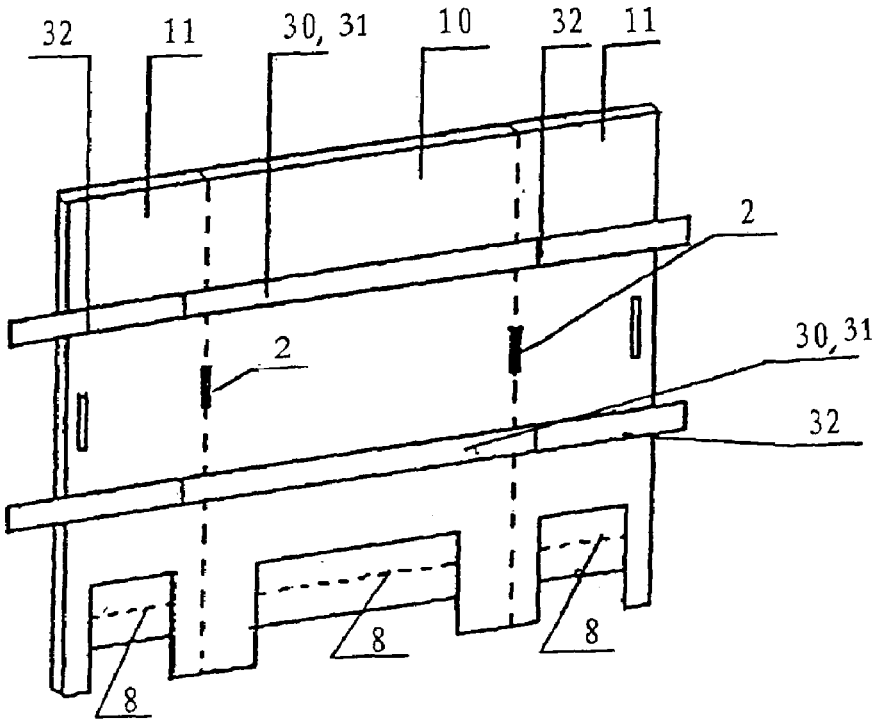
FIG. 5 is a schematic view of the structure of another example in this utility model.

The structure of Example 2 is the same as that of Example 1, except that folding template body 1, main template 10, and auxiliary template 11 are the left, middle, and right templates. That is to say, both sides of main template 10 are connected to the left auxiliary template 11 and the right auxiliary template 11 to form a folding template body 1 by connecting pieces 2, as shown in FIG. 5. As can be seen in FIGS. 4 and 5, one surface of template body is equipped with at least one cross rod 30. Each of the cross rods 30 includes a hollow steel tube main rod 31 and an accessory rod 32 which may be inserted into and retracted from double ends of the main rod 31. (See FIGS. 4 and 5). The lower ends of main template 10 and auxiliary templates 11 of template body 1 are equipped with template locks 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A template for carrying bulk cargo in an active container, comprising:

a folding template body;

template connecting pieces and a discharge door, the template body having at least portions thereof connected together by the template connecting pieces to form the folding template body;

multiple template locks on the template body, each of the template locks having locking bars and a lock head;

transverse ribs fixed to the template body in a positions between at least some of the locking bars of the template body, each of the transverse ribs having one of the locking bar above and another locking bar below, wherein the template body is fixed to upright posts of a doorframe on the right and left sides of the container by inserting the locking bars of the template locks into the doorframe, wherein sealing members are provided on two sides of the template body, and the discharge door is located below the lower-most locking bar of the template body.

2. The template for carrying bulk cargo in an active container according to claim 1, wherein the folding template body is formed by connecting together a main template and at least one auxiliary template by the connecting pieces, the main template and the at least one auxiliary template being an upper template and a lower template, and wherein at least one of the template locks is provided on each of the templates of the folding template body.

3. The template for carrying bulk cargo in an active container according to claim 1, wherein the connecting pieces are latch hinges.

4. The template for carrying bulk cargo in an active container according to claim 1, wherein each of the locking bars is connected to the lock head.

5. The template for carrying bulk cargo in an active container according to claim 1, wherein the template body is provided with a hollow steel tube is established around periphery of the template body.

6. The template for carrying bulk cargo in an active container according to claim 1, wherein the discharge door is connected to the template body by a hinge, and a door lock is provided on the discharge door.

7. The template for carrying bulk cargo in an active container according to claim 1, further comprising:

a bulk cargo underlay bag to be fitted into the template body for covering inner walls of the template body when the template body is fixed to the container, the bulk cargo underlay bag including:

a plurality of connector links on an outer periphery of the underlay bag for connecting the underlay bag to inside edge connector links of the container for positioning of the bag;

at least two discharge ports provided at one end of underlay bag adjacent to a lower part of a container door; and a loading port and a return air port provided on an upper part of the container door.

8. The template for carrying bulk cargo in an active container according to claim 1, wherein the folding template body is formed of an upper template and a lower template which connect together by the connecting pieces to form the folding template body, and wherein at least one of the template locks is provided on each of the templates of the folding template body.

9. The template for carrying bulk cargo in an active container according to claim 1, wherein peripheral edges of the template body are pressed molded into flanged edges.

10. The template for carrying bulk cargo in an active container according to claim 1, wherein all of the locking bars on the template body are above the discharge door.

11. The template for carrying bulk cargo in an active container according to claim 10, wherein the lock heads are centrally located on the template body and the locking bars extend laterally from each of the lock heads to right and left sides of the container.

12. A template for carrying bulk cargo in an active container, comprising:

a folding template body;

template connecting pieces;

a pair of rectangular-shaped discharge doors that are substantially equal in size, the template body having at least portions thereof connected together by the template connecting pieces to form the folding template body;

multiple template locks on the template body, each of the template locks having a locking bar and a lock head, the lock head being centrally located on the template body, wherein the template body is fixed to upright posts of a doorframe of the container by inserting the locking bars of the template locks into the doorframe, wherein sealing members are provided on two sides of the template body, and the rectangular-shaped discharge doors are located at a lower end of the template body, the doors being separated from each other in a lateral direction by a closed panel of the template body, and being separated from the two sides of the template body by other closed panels of the template body.

13. The template for carrying bulk cargo in an active container according to claim 10, wherein all of the locking bars on the template body are disposed above the rectangular-shaped discharge doors.

14. A template for carrying bulk cargo in an active container, comprising:

a folding template body;

template connecting pieces and a pair of discharge doors, the template body having at least portions thereof connected together by the template connecting pieces to form the folding template body;

multiple template locks arranged one above another on the template body, each of the template locks having a locking bar and a lock head, multiple transverse ribs extending across and fixed to a central portion of the template body, with no transverse ribs being above the upper-most locking bar or below the lower-most locking bar, wherein the template body is fixed to upright posts of a doorframe of the container by inserting the locking bars of the template locks into the doorframe, wherein sealing members are provided on two sides of the template body, and the lower-most locking bar is disposed between the discharge doors and the lower-most transverse rib.

15. The template for carrying bulk cargo in an active container according to claim 14, wherein the all of the locking bars on the template body are above the discharge doors.

* * * * *